US011441226B2

(12) United States Patent
Birkenheuer et al.

(10) Patent No.: US 11,441,226 B2
(45) Date of Patent: Sep. 13, 2022

(54) METHOD FOR ANTI-CORROSION PRE-TREATMENT OF A METAL SURFACE CONTAINING STEEL, GALVANISED STEEL, ALUMINIUM, MAGNESIUM AND/OR A ZINC-MAGNESIUM ALLOY

(71) Applicant: CHEMETALL GMBH, Frankfurt (DE)

(72) Inventors: Stefan Birkenheuer, Frankfurt am Main (DE); Carina Hecker, Frankfurt am Main (DE); Oliver Sauer, Frankfurt am Main (DE); Daniel Schatz, Frankfurt am Main (DE)

(73) Assignee: CHEMETALL GMBH, Frankfurt (DE)

( * ) Notice: Subject to any disclaimer, the term of this patent is extended or adjusted under 35 U.S.C. 154(b) by 793 days.

(21) Appl. No.: 16/312,908

(22) PCT Filed: Jun. 21, 2017

(86) PCT No.: PCT/EP2017/065186
§ 371 (c)(1),
(2) Date: Dec. 21, 2018

(87) PCT Pub. No.: WO2017/220632
PCT Pub. Date: Dec. 28, 2017

(65) Prior Publication Data

US 2019/0330745 A1 Oct. 31, 2019

(30) Foreign Application Priority Data

Jun. 22, 2016 (DE) ..... 102016211152.3

(51) Int. Cl.
*C23C 22/34* (2006.01)
*C23C 22/80* (2006.01)
*C23C 22/78* (2006.01)

(52) U.S. Cl.
CPC ..... *C23C 22/78* (2013.01); *C23C 22/34* (2013.01); *C23C 2222/20* (2013.01)

(58) Field of Classification Search
CPC ..... C23C 22/78; C23C 22/34; C23C 2222/20; C23C 22/83; C23C 22/36; C23C 22/73
See application file for complete search history.

(56) References Cited

FOREIGN PATENT DOCUMENTS

| | | | | |
|---|---|---|---|---|
| CA | 2425403 | A1 * | 4/2003 | ..... C23C 22/34 |
| DE | 102015225185 | A1 * | 6/2016 | ..... C23C 22/361 |
| DE | 102015225185 | A1 | 6/2016 | |
| WO | 2013020980 | A1 | 2/2013 | |
| WO | WO-2016096777 | A1 | 6/2016 | |
| WO | 2017220632 | A1 | 12/2017 | |

OTHER PUBLICATIONS

International Search Report for International Application No. PCT/EP2017/065186, dated Nov. 15, 2017, 2 pages.

* cited by examiner

*Primary Examiner* — Alexander M Weddle
(74) *Attorney, Agent, or Firm* — Armstrong Teasdale LLP

(57) ABSTRACT

Described herein is an improved process for an anticorrosion pretreatment of a metallic surface including steel, galvanized steel, aluminum, magnesium and/or a zinc-magnesium alloy, wherein the metallic surface is brought into contact with an aqueous composition A including a) from 0.01 to 0.5 g/l of a copolymer and the metallic surface is brought into contact with an acidic aqueous composition B including b1) a compound selected from the group consisting of titanium, zirconium and hafnium compounds, wherein the metallic surface is brought into contact i) firstly with the composition A and then with the composition B, ii) firstly with the composition B and then with the composition A and/or iii) simultaneously with the composition A and the composition B.

Also described herein is a corresponding aqueous composition A, an aqueous concentrate for producing this composition, a correspondingly coated metallic surface and a method of using a correspondingly coated metallic substrate.

17 Claims, No Drawings

METHOD FOR ANTI-CORROSION PRE-TREATMENT OF A METAL SURFACE CONTAINING STEEL, GALVANISED STEEL, ALUMINIUM, MAGNESIUM AND/OR A ZINC-MAGNESIUM ALLOY

CROSS-REFERENCE TO RELATED APPLICATIONS

This application is a U.S. National Phase Application of PCT/EP2017/065186, filed Jun. 21, 2017, which claims the benefit of priority to German Patent Application No. 102016211152.3, filed Jun. 22, 2016, the entire contents of which are hereby incorporated by reference herein.

FIELD OF INVENTION

The present invention relates to an improved process for the anticorrosion pretreatment of a metallic surface comprising steel, galvanized steel, aluminum, magnesium and/or a zinc-magnesium alloy. It further relates to a composition for improving the anticorrosion pretreatment of such a metallic surface, a concentrate for producing this composition, a correspondingly coated metallic surface and also the use of a correspondingly coated metallic substrate.

BACKGROUND

The coating of metallic surfaces with an aqueous composition comprising organoalkoxysilanes, hydrolysis and/or condensation products thereof and also further components is known.

Corrosion protection for the treated metal substrates can be achieved by means of the coatings formed, as can a certain improvement in the adhesion of further layers such as surface coatings.

The addition of particular acid-stable polymers to the abovementioned compositions is also disclosed in the prior art. The properties of the layers formed can be improved in this way.

However, problems in respect of corrosion delamination, which have also hitherto not been able to be solved satisfactorily by use of the polymers mentioned, still occur, particularly in the case of surfaces comprising steel or galvanized steel.

DESCRIPTION

It is an object of the present invention to overcome the disadvantages of the prior art and provide an improved process for anticorrosion pretreatment for metallic surfaces comprising steel, galvanized steel, aluminum, magnesium and/or a zinc-magnesium alloy, by means of which process corrosion protection of steel substrates, in particular, can be improved with simultaneously good adhesion.

The object is achieved by a process according to the present application, an aqueous composition according to the present application, a concentrate according to the present application, a metallic surface according to the present application and also the use of a metallic substrate according to the present application.

In the process of the invention for the anticorrosion pretreatment of a metallic surface comprising steel, galvanized steel, aluminum, magnesium and/or a zinc-magnesium alloy, the metallic surface is brought into contact with an aqueous composition A which comprises a) from 0.01 to 0.5 g/l (calculated as solid addition) of at least one copolymer comprising, in an alternating configuration, i) monomer units which comprise at least one carboxylic acid group, phosphonic acid group and/or sulfonic acid group and ii) monomer units which do not comprise any acid group, and brought into contact with an acidic aqueous composition B which comprises b1) at least one compound selected from the group consisting of titanium, zirconium and hafnium compounds, wherein the metallic surface is brought into contact i) firstly with the composition A and then with the composition B, ii) firstly with the composition B and then with the composition A and/or iii) simultaneously with the composition A and the composition B.

Definitions:

For the purposes of the present invention, an "aqueous composition" includes a composition which comprises not only water as solvent/dispersion medium but also less than 50% by weight, based on the total amount of the solvent/dispersion medium, of other, organic solvents/dispersion media.

For the purposes of the present invention, "calculated as hexafluorozirconic acid" refers to the fictitious situation that all molecules of the component b1) in the composition B are hexafluorozirconic acid molecules, i.e. $H_2ZrF_6$.

"Complex fluorides" encompass not only the deprotonated forms but also the respective monoprotonated or multiply protonated forms.

The expression "the metallic surface is brought into contact i) firstly with the composition A and then with the composition B, ii) firstly with the composition B and then with the composition A and/or iii) simultaneously with the composition A and the composition B"

should be interpreted as meaning that the following embodiment is also encompassed:

the metallic surface is brought into contact in succession with a first composition A, with a composition B and with a second composition A, with the first and second compositions A also being able to be chemically identical.

The expression "the metallic surface is brought into contact [ . . . ] iii) simultaneously with the composition A and the composition B" should be interpreted as meaning that it can also be brought into contact with a single composition which is an acidic aqueous composition comprising all components a), b1) and optionally b2).

The metallic surface preferably comprises steel or galvanized steel, particularly preferably galvanized steel and very particularly preferably hot-galvanized steel. In the case of these materials in particular, problems in respect of corrosion delamination occurred hitherto but these have been able to be solved satisfactorily by the present invention.

The at least one copolymer a) in the composition A is preferably stable at least in a subrange of the pH below 6. This is necessary when the metallic surface is, as described above, to be brought into contact with a single composition which is an acidic aqueous composition comprising all components a), b1) and optionally b2).

The addition according to the invention of the at least one copolymer a) enables the properties of the coatings formed, in particular the corrosion protection, to be significantly improved.

During the treatment of the metallic surface with the acidic aqueous composition B, pickling of the surface and consequently formation of a pH gradient with an increasing pH in the direction of the surface occur.

The copolymers used according to the invention comprise acid groups which at least partially dissociate at the elevated pH at the surface. This leads to negative charges on the copolymer, which in turn lead to electrostatic attachment of the copolymer to the metallic surface and/or to the metal oxides from the component b1) and optionally to the component b2) and optionally to the component b3). The attached copolymer increases the barrier action of the deposited layers against diffusion or migration of corrosive salts to the metallic surface. The properties of the layers formed are improved thereby.

The monomer units i) of the at least copolymer a) in the composition A, which comprise at least one carboxylic acid group, phosphonic acid group and/or sulfonic acid group, are, for example, (meth)acrylic acid, vinylacetic acid, itaconic acid, maleic acid, vinylphosphonic acid and/or vinylsulfonic acid.

These monomer units preferably each have at least one carboxylic acid group. They more preferably each have at least two carboxylic acid groups. They particularly preferably have precisely two carboxylic acid groups. Very particular preference is given here to maleic acid.

If the at least one copolymer a) in the composition A comprises maleic acid as monomer unit, this can be present partly in the form of the anhydride. This is the case when the copolymer added to the composition A or to the concentrate for producing this composition comprises maleic anhydride and as yet no complete hydrolysis to maleic acid has taken place in the composition A or in the concentrate.

The monomer units ii) of the at least one copolymer a) in the composition A, which do not comprise any acid group, can be either nonpolar or polar. The at least one copolymer a) can however, also comprise a mixture of nonpolar and polar monomer units as monomer units which do not comprise any acid group.

Possible nonpolar monomer units are, in particular, alkylenes, for example ethylene, propylene and/or butylene, and/or styrene.

Possible polar monomer units are, in particular, vinyl alcohol and/or vinyl acetate and/or vinyl ethers, for example methyl vinyl ether, ethyl vinyl ether, propyl vinyl ether and/or butyl vinyl ether, and/or alkylene oxides, for example ethylene oxide, propylene oxide and/or butylene oxide, and/or ethyleneimine and/or (meth)acrylic esters and/or (meth)acrylamide.

The length of the hydrocarbon chains in the monomer units ii) which do not comprise any acid group is merely restricted by the resulting hydrophobicity of these monomers and thus by the water-solubility of the resulting copolymer.

Monomer units ii) which do not comprise any acid group are preferably vinyl ether. Further preference is given here to methyl vinyl ether and/or ethyl vinyl ether, particularly preferably methyl vinyl ether.

In a preferred embodiment, the composition A comprises poly(methyl vinyl ether-alt-maleic acid) as copolymer a).

The at least one copolymer a) in the composition A preferably has a degree of polymerization based on two monomer units in an alternating configuration of from 25 to 5700, more preferably from 85 to 1750, particularly preferably from 170 to 1300 and very particularly preferably from 225 to 525. Its number average molecular weight is preferably from 5000 to 1 000 000 g/mol, more preferably from 15 000 to 300 000 g/mol, particularly preferably from 30 000 to 225 000 g/mol and very particularly preferably from 40 000 to 90 000 g/mol.

In a very particularly preferred embodiment, the composition A comprises poly(methyl vinyl ether-alt-maleic acid) having a number average molecular weight in the range from 40 000 to 60 000 g/mol, preferably about 48 000 g/mol, as the at least one copolymer a).

In a further very particularly preferred embodiment, the composition A comprises poly(methyl vinyl ether-alt-maleic acid) having a number average molecular weight in the range from 70 000 to 90 000 g/mol, preferably about 80 000 g/mol, as the at least one copolymer a).

These alternating copolymers can be procured, for example, from Ashland (Gantrez 119 AN) or Sigma-Aldrich.

In a preferred embodiment, the metallic surface is i) firstly brought into contact with the composition A and then with the composition B, with the concentration of the at least one copolymer a) in the composition A being in the range from 0.01 to 0.5 g/l, preferably from 0.05 to 0.3 g/l (calculated as solid addition).

In a further preferred embodiment, the metallic surface is iii) brought into contact simultaneously with the composition A and the composition B, with the concentration of the at least one copolymer a) in the composition A being in the range from 10 to 500 mg/l, preferably from 20 to 200 mg/l, more preferably from 20 to 150 mg/l, more preferably from 30 to 100 mg/l and very particularly preferably from 40 to 60 mg/l (calculated as solid addition).

The composition B preferably has a pH in the range from 0.5 to 5.5, more preferably from 2 to 5.5, particularly preferably from 3.5 to 5.3 and very particularly preferably from 4.0 to 5.0. The pH is preferably set by means of nitric acid, ammonium and/or sodium carbonate.

The composition B preferably additionally comprises b2) at least one compound selected from the group consisting of organoalkoxysilanes, organosilanols, polyorganosilanols, organosiloxanes and polyorganosiloxanes.

With regard to the at least one compound of the component b2) in the composition B, the prefix "organo" refers to at least one organic group which is bound directly via a carbon atom to a silicon atom and consequently cannot be split off from the latter hydrolytically.

For the purposes of the present invention, "polyorganosiloxanes" are compounds which can be condensed from at least two organosilanols and do not form polydimethylsiloxane.

In the composition B, the concentration of b2) is preferably in the range from 1 to 200 mg/l, more preferably from 5 to 100 mg/l, particularly preferably from 20 to 50 mg/l and very particularly preferably from 25 to 45 mg/l (calculated as silicon).

In the composition B, the concentration of b1) is preferably in the range from 0.05 to 4 g/l, more preferably from 0.1 to 1.5 g/l, more preferably from 0.15 to 0.57 g/l, particularly preferably from 0.20 to 0.40 g/l and very particularly preferably about 0.25 g/l, (calculated as hexafluorozirconic acid).

The contents of the components b1), b2) and b3) (see below) can be monitored by means of ICP-OES (optical emission spectrometry with inductively coupled plasma) or to an approximation photometrically during the treatment of the metallic surfaces, so that introduction of further amounts of individual components or a plurality of components can be carried out if necessary.

The composition B preferably comprises at least one organoalkoxysilane, organosilanol, polyorganosilanol, organosiloxane and/or polyorganosiloxane having at least one amino group, urea group, imido group, imino group and/or ureido group per organoalkoxysilane/organosilanol unit as component b2). Further preference is given to the component b2) being at least one organoalkoxysilane, organosilanol, polyorganosilanol, organosiloxane and/or polyorganosiloxane having at least one, in particular one or two, amino group(s) per organoalkoxysilane/organosilanol unit.

Particular preference is given to 2-aminoethyl-3-aminopropyltrimethoxysilane, 2-aminoethyl-3-aminopropyltriethoxysilane, bis(trimethoxysilylpropyl)amine or bis(triethoxysilylpropyl)amine or a combination of these as organoalkoxysilane/organosilanol unit. Very particular preference is given to 2-aminoethyl-3-aminopropyltrimethoxysilane or bis(trimethoxysilylpropyl)amine or a combination of the two as organoalkoxysilane/organosilanol unit.

The composition B preferably comprises at least one complex fluoride selected from the group consisting of the complex fluorides of titanium, zirconium and hafnium as component b1).

Further preference is given here to zirconium complex fluoride. Here, zirconium can also be added as zirconyl nitrate, zirconium carbonate, zirconyl acetate or zirconium nitrate, preferably as zirconyl nitrate. This applies analogously in the case of titanium and hafnium.

The content of the at least one complex fluoride is preferably in the range from 0.05 to 4 g/l, more preferably from 0.1 to 1.5 g/l and particularly preferably about 0.25 g/l (calculated as hexafluorozirconic acid).

In a preferred embodiment, the composition B comprises at least two different complex fluorides, in particular complex fluorides of two different metal cations and particularly preferably complex fluorides of titanium and of zirconium, as component b1).

The composition B preferably additionally comprises a component b3) which is at least one type of cation selected from the group consisting of cations of metals of transition groups 1 to 3 and 5 to 8 including the lanthanides and also of main group 2 of the Periodic Table of the Elements and also of lithium, of bismuth and of tin and/or is at least one corresponding compound.

The component b3) is preferably at least one type of cation selected from the group consisting of the cations of cerium and further lanthanides, chromium, iron, calcium, cobalt, copper, magnesium, manganese, molybdenum, nickel, niobium, tantalum, yttrium, vanadium, lithium, bismuth, zinc and tin and/or at least one corresponding compound.

The composition B more preferably comprises zinc cations, copper cations and/or cerium cations and/or at least one molybdenum compound as component b3).

The composition B particularly preferably comprises zinc cations, very particularly preferably zinc cations and copper cations, as component b3).

The concentrations in the composition B are preferably as follows:

zinc cations: from 0.1 to 5 g/l
copper cations: from 5 to 50 mg/l
cerium cations: from 5 to 50 mg/l to
molybdenum compound: from 10 to 100 mg/l (calculated as molybdenum).

The composition B optionally comprises, depending on specific requirements and circumstances, an additional component b4). This is at least one compound selected from the group consisting of substances which influence the pH, organic solvents, water-soluble fluorine compounds and colloids.

The composition B here preferably has a content of the component b4) in the range from 0.1 to 20 g/l.

The substances which influence the pH are preferably selected from the group consisting of nitric acid, sulfuric acid, methanesulfonic acid, acetic acid, hydrofluoric acid, ammonium/ammonia, sodium carbonate and sodium hydroxide. Further preference is given here to nitric acid, ammonium and/or sodium carbonate.

The organic solvents are preferably selected from the group consisting of methanol and ethanol. In practice, methanol and/or ethanol are present as reaction products of the organoalkoxysilane hydrolysis in the treatment baths.

The water-soluble fluorine compounds are preferably selected from the group consisting of fluoride-comprising compound and fluoride anions.

The content of free fluoride in the composition B is preferably in the range from 0.015 to 0.15 g/l, more preferably from 0.025 to 0.1 g/l and particularly preferably in the range from 0.03 to 0.05 g/l.

The colloids are preferably metal oxide particles, more preferably metal oxide particles selected from the group consisting of ZnO, $SiO_2$, $CeO_2$, $ZrO_2$ and $TiO_2$.

The composition B preferably additionally comprises at least one type of cations selected from the group consisting of alkali metal ions, ammonium ions and corresponding compounds. It particularly preferably comprises sodium ions and/or ammonium ions.

The composition B can also comprise phosphorus- and oxygen-comprising compounds such as phosphates and/or phosphonates. In addition, it can comprise nitrate.

However, the content of sulfur-comprising compounds, in particular sulfate, should preferably be kept as small as possible. The content of sulfur-comprising compounds is particularly preferably below 100 mg/l calculated as sulfur.

The metallic surface to be treated, which has optionally been cleaned and/or pickled beforehand, can in each case be sprayed with the composition A and/or with the composition B, dipped into this or flooded with this. It is also possible to apply the respective composition manually by wiping or brushing or by means of rolls or rollers (coil coating process) to the metallic surface to be treated. In addition, electrolytic deposition of the respective composition on the metallic surface to be treated is possible.

The treatment time in the treatment of parts is preferably in the range from 15 seconds to 20 minutes, more preferably from 30 seconds to 10 minutes and particularly preferably in the range from 45 seconds to 5 minutes. The treatment temperature is preferably in the range from 5 to 50° C., more preferably from 15 to 40° C. and particularly preferably in the range from 25 to 35° C.

The process of the invention is also suitable for the coating of strips (coils). The treatment time is in this case preferably in the range from a few seconds to some minutes, for instance in the range from 1 to 1000 seconds.

The process of the invention enables a mix of various metallic materials to be coated in the same bath (known as multimetal capability).

The metallic surface to be treated preferably comprises steel, galvanized steel, aluminum, magnesium and/or a zinc-magnesium alloy; it further preferably comprises steel and/or galvanized steel; it particularly preferably comprises steel.

In the case of metallic surfaces comprising steel, in particular, greatly improved corrosion protection after cathodic electrophoretic coating (CEC) was observed after coating by means of the process of the invention.

The present invention also provides an aqueous composition A for improving the anticorrosion pretreatment of a metallic surface comprising steel, galvanized steel, aluminum, magnesium and/or a zinc-magnesium alloy, as described above.

In addition, the invention provides a concentrate from which a composition A according to the invention can be produced by dilution with water and optionally setting of the pH.

The treatment bath comprising the composition A of the invention can be obtained by dilution of the concentrate with water and/or an aqueous solution, preferably by a factor of from 1:5000 to 1:10, more preferably from 1:1000 to 1:10, particularly preferably from 1:300 to 1:10 and particularly preferably by a factor of about 1:100.

In addition, the present invention provides a metallic surface which comprises steel, galvanized steel, aluminum, magnesium and/or a zinc-magnesium alloy and has been coated by means of the process of the invention, wherein the coating formed has a layer weight determined by means of XRF (X-ray fluorescence analysis) of:

i) from 5 to 500 mg/m$^2$, preferably from 10 to 200 and particularly preferably from 30 to 120 mg/m$^2$, based only on component b1) (calculated as zirconium) and optionally ii) from 0.5 to 50 mg/m$^2$, preferably from 1 to 30 and particularly preferably from 2 to 10 mg/m$^2$, based only on component b2) (calculated as silicon).

The coatings produced by the process of the invention serve as corrosion protection and also as bonding agents for further coatings.

Thus, they can easily be coated further with at least one primer, surface coating, adhesive and/or coating-like organic composition. Here, at least one of these further coatings can preferably be cured by heating and/or irradiation.

The coatings produced by the process of the invention are preferably rinsed in order to remove excess polymer and interfering ions from the metallic surface before further treatment. The first further coating can be applied by the wet-in-wet process.

As surface coating, preference is given to applying a cathodic electrophoretic coating (CEC) based on epoxides and/or (meth)acrylates.

Finally, the present invention also provides for the use of a metallic substrate which has been coated by the process of the invention in the automobile industry, for rail vehicles, in the aerospace industry, in apparatus construction, in mechanical engineering, in the building industry, in the furniture industry, for the production of crash barriers, lamps, profiles, cladding or small parts, for the production of bodywork or bodywork parts, of individual components, preinstalled or joined elements, preferably in the automobile or aviation industry, for the production of apparatuses or plants, in particular of domestic appliances, control devices, testing instruments or construction elements.

Preference is given to using the coated metallic substrates for the production of bodywork or bodywork parts, of individual components and of preinstalled or joined elements in the automobile industry.

The present invention will be illustrated by the following examples, which are not to be interpreted as constituting a restriction.

EXAMPLES i) Substrates and Pretreatment:

Substrates:

Sheets (10.5×19 cm) made of hot-galvanized steel (HDG) were used as substrates.

Cleaning:

In all examples, Gardoclean® S 5176 (from Chemetall; comprises phosphate, borate and surfactant) was used as mild-alkaline dipping cleaner. For this purpose, 15 g/l were made up in a 50 l bath, heated to 60° C. and the substrates were cleaned by spraying for 3 minutes at a pH in the range from 10.0 to 11.0. The substrates were subsequently rinsed with mains water and deionized water.

Prerinse (According to the Invention):

The prerinse was carried out using deionized water to which 200 mg/l (calculated as solid addition) of poly(methyl vinyl ether-alt-maleic acid) ($M_n$=80 000; from Sigma-Aldrich) had optionally been added according to the invention (cf. Tab. 1: "Polym.").

The prerinse of the substrates was carried out for 120 seconds at 20° C. with moderate stirring.

Conversion Bath (According to the Invention):

For the conversion bath, the Oxsilan® additive 9936 (from Chemetall; contains fluoride and a zirconium compound) and optionally Oxsilan® AL 0510 (from Chemetall; contains 2-aminoethyl-3-aminopropyltrimethoxysilane and bis(trimethoxy-silylpropyl)amine, cf. Tab. 1: "Silane") was or were added to a 50 l batch in such an amount that a zirconium concentration of 100 mg/l and a silane concentration of 30 mg/l (calculated as Si) resulted. The bath temperature was set to 30° C. The pH and the free fluoride content were set to pH=4.8 or 30-40 mg/l, respectively, by addition of dilute sodium hydrogencarbonate solution and dilute hydrofluoric acid (5% strength).

The pH was corrected continuously by addition of dilute nitric acid.

According to the invention, 50 or 200 mg/l (calculated as solid addition) of poly(methyl vinyl ether-alt-maleic acid) ($M_n$=80 000; from Sigma-Aldrich) were optionally added to the bath (cf. Tab. 1: "Polym.").

8 mg/l of copper in the form of copper sulfate were optionally also added to the bath according to the invention (cf. Tab. 1: "Cu").

Before substrates were passed through, the finished bath was left to age for at least 12 hours in order to be able to ensure establishment of a chemical equilibrium within the bath. The conversion treatment was carried out for 120 seconds with moderate stirring. Rinsing with mains water and deionized water was subsequently carried out.

ii) Analysis, Coating, Bond Strength and Corrosion Protection

X-Ray Fluorescence Analysis

The layer weights (LW) in mg/m$^2$ on the pretreated substrates were determined by means of X-ray fluorescence analysis (XRF). Here, the amount of zirconium applied was measured.

Surface Coating

The pretreated substrates were coated by CEC. Cathoguard® 800 (from BASF) was used for this purpose. A buildup coating was subsequently applied. This was Daimler Black. The thickness of the surface coating layer was determined by means of a layer thickness measuring instrument in accordance with DIN EN ISO 2808 (version 2007). It was in the range from 90 to 110 μm. For the cataplasma test (see below), no buildup coating was applied. Here, the layer thickness of the CEC was in the range from 20 to 25 μm.

Corrosion Tests

In addition, five different corrosion tests were carried out:

1.) the corrosion cycle test according to Volkswagen specification PV 1210 (version 2010-02) over 60 rounds, 2.) the corrosion cycle test according to VDA test sheet 621-415 and according to DIN EN ISO 20567-1 (version 1982; method C) over 10 rounds, 3.) the corrosion cycle test Meko S test c in accordance with DIN EN ISO 4628-8 (version 2013-03), 4.) the condensation water test in accordance with DIN EN ISO 6270-2 CH (version 2005) and 5.) the cataplasma test PSA D47 1165 (version 2014).

Delamination

In the case of the corrosion tests 1.) to 3.), the corrosion delamination in mm was in each case determined in accordance with DIN EN ISO 4628-8 (version 2012) (cf. Tab. 1: "CD").

Stone Impact

In the case of the corrosion tests 1.) and 2.), a stone impact in accordance with DIN EN ISO 20567-1 (version 1982; method C) was additionally carried out and evaluated (cf. Tab. 1: "SIT").

Cross-Cut Test

In the case of the corrosion tests 4.) and 5.), the metal sheets were stored at room temperature for 24 hours (condensation water test) or 1 hour (cataplasma test). Cross-cuts were then carried out in accordance with DIN EN ISO 2409 (version 2013), with "0" denoting the best-possible value and "5" representing the worst possible value (cf. Tab. 2: "C-C").

iii) Results and Discussion

Tab. 1 shows that when poly(methyl vinyl ether-alt-maleic acid) is used in the conversion bath, it is possible to achieve better corrosion protection results than when it is used in the prerinse (E2 compared to E1 and E4 compared to E3). Nevertheless, the results in the case of the prerinse according to the invention are still satisfactory.

Reference may in this respect also be made to the results in Tab. 2, which display good cross-cut results, especially in the case of addition of silane (E1 and E3, cf. also the following paragraph).

Furthermore, it can be seen from Tab. 1 that the addition of a silane to the conversion bath brings about a further improvement in the corrosion protection results (E3 compared to E1 and E4 compared to E2). This likewise applies to the addition of copper to the conversion bath (E5 compared to E4). Furthermore, the addition of copper leads to increased deposition of zirconium on the substrates.

Finally, when the concentration of poly(methyl vinyl ether-alt-maleic acid) is increased from 50 to 200 mg/l in the conversion bath, there is some worsening of the corrosion protection results (E6 compared to E5).

TABLE 1

| Ex. | Silane | Polym. [mg/l] | Appl. of polym.[4] | Cu | LW (Zr) [mg/m²][3] | PV 1210 CD[1] | PV 1210 SIT[1] | VDA 621-415 CD[2] | VDA 621-415 SIT[2] | Meko[2] |
|---|---|---|---|---|---|---|---|---|---|---|
| E1 | – | 200 | Prerinse | – | 102 | 3.1 | 3.4 | n.d. | n.d. | n.d. |
| E2 | – | 50 | Conv. | – | 70 | 2.9 | 3.6 | n.d. | n.d. | n.d. |
| E3 | + | 200 | Prerinse | – | 51 | 2.9 | 2.8 | n.d. | n.d. | n.d. |
| E4 | + | 50 | Conv. | – | 36 | 2.6 | 2.3 | 1.6 | 2.0 | 5.5 |
| E5 | + | 50 | Conv. | + | 73 | n.d. | n.d. | 1.4 | 1.5 | 4.9 |
| E6 | + | 200 | Conv. | + | 63 | n.d. | n.d. | 1.6 | 1.7 | 5.0 |

[1]= Average from two metal sheets
[2]= Average from three metal sheets
[3]= Average from 2 or 3 metal sheets
[4]= Application of the polymer

TABLE 2

| Ex. | Condensation water, C—C = . . .[1] | Cataplasma, C—C = . . .[1] |
|---|---|---|
| E1 | 1.5 | 2.0 |
| E3 | 0.0 | 0.0 |

[1]= Average from two metal sheets

The invention claimed is:

1. A process for an anticorrosion pretreatment of a metallic surface comprising steel, galvanized steel, aluminum, magnesium and/or a zinc-magnesium alloy, wherein the metallic surface is brought into contact with an aqueous composition A comprising a) from 0.01 to 0.5 g/l (calculated as solid addition) of at least one copolymer comprising, in an alternating configuration, i) monomer units comprising at least one carboxylic acid group, phosphonic acid group and/or sulfonic acid group and ii) monomer units not comprising any acid group, and the metallic surface is brought into contact with an acidic aqueous composition B comprising b1) at least one compound selected from the group consisting of titanium, zirconium and hafnium compounds, wherein the metallic surface is brought into contact i) firstly with the composition A and then with the composition B, or ii) firstly with the composition B and then with the composition A.

2. The process according to claim 1, wherein the monomer units i) comprising at least one carboxylic acid group, phosphonic acid group and/or sulfonic acid group and the monomer units ii) not comprising any acid group in the at least one copolymer a) in the composition A are alkylenes, styrene, vinyl alcohol, vinyl acetate, vinyl ethers, ethylenimine, (meth)acrylic esters and/or (meth)acrylamide.

3. The process according to claim 2, wherein the monomer units i) have two carboxylic acid groups and the monomer units ii) are vinyl ethers in a) in the composition A.

4. The process according to claim 1, wherein the at least one copolymer a) in the composition A has a degree of polymerization based on two monomer units in an alternating configuration in the range from 25 to 5700 and/or its number average molecular weight is in the range from 5000 to 1 000 000 g/mol.

5. The process according to claim 1, wherein the metallic surface is brought into contact i) firstly with the composition A and then with the composition B, wherein a concentration of the at least one copolymer a) in the composition A is in the range from 0.01 to 0.5 g/l (calculated as solid addition).

6. The process according to claim 1, wherein a pH of the composition B is in the range from 2 to 5.5.

7. The process according to claim 1, wherein the composition B additionally comprises b2) at least one compound selected from the group consisting of organoalkoxysilanes, organosilanols, polyorganosilanols, organosiloxanes and polyorganosiloxanes.

8. The process according to claim 7, wherein, in the composition B, a concentration of b2) is in the range from 1 to 200 mg/l (calculated as silicon) and that of b1) is in the range from 0.05 to 4 g/l (calculated as hexafluorozirconic acid).

9. The process according to claim 7, wherein b2) in the composition B is at least one organoalkoxysilane, organosilanol, polyorganosilanol, organosiloxane and/or polyorganosiloxane having in each case at least one amino group, urea group, imido group, imino group and/or ureido group per organoalkoxysilane/organosilanol unit.

10. The process according to claim 1, wherein b1) in the composition B is at least one complex fluoride selected from the group consisting of a complex fluoride of titanium, zirconium and hafnium.

11. The process according to claim 1, wherein a content of free fluoride in the composition B is in the range from 0.015 to 0.15 g/l.

12. The process according to claim 1, wherein the composition B additionally comprises b3) at least one type of cation selected from the group consisting of cations of metals of transition groups 1 to 3 and 5 to 8 including the lanthanides, cations of metals of main group 2 of the Periodic Table of the Elements, cations of lithium, bismuth, tin, and/or at least one corresponding compound.

13. The process according to claim 12, wherein the composition B additionally comprises b3) at least one type of cation selected from the group consisting of the cations of cerium and further lanthanides, chromium, iron, calcium, cobalt, copper, magnesium, manganese, molybdenum, nickel, niobium, tantalum, yttrium, vanadium, lithium, bismuth, zinc and tin and/or at least one corresponding compound.

14. The process according to claim 13, wherein the composition B comprises a zinc cation, copper cation, and/or cerium cation, and/or at least one molybdenum compound as b3).

15. The process according to claim 14, wherein the composition B comprises from 0.1 to 5 g/l of zinc cations, from 5 to 50 mg/l of copper cations and/or from 5 to 50 mg/l of cerium cations and/or from 10 to 100 mg/l of at least one molybdenum compound (calculated as molybdenum) as b3).

16. The process according to claim 1, wherein the metallic surface comprises steel and/or galvanized steel.

17. A method of using a metallic substrate which has been coated by a process according to claim 1 in the automobile industry, for rail vehicles, in the aerospace industry, in apparatus construction, in mechanical engineering, in the building industry, in the furniture industry, for the production of crash barriers, lamps, profiles, cladding or small parts, for the production of bodywork or bodywork parts, of individual components, preinstalled or joined elements.

* * * * *